United States Patent [19]

Bragagnolo

[11] Patent Number: 4,780,968

[45] Date of Patent: Nov. 1, 1988

[54] HEATER DEVICE, PARTICULARLY FOR SKI BOOTS

[75] Inventor: Silvano Bragagnolo, Castelfranco Veneto, Italy

[73] Assignee: Nordica S.p.A., Montebelluna TV, Italy

[21] Appl. No.: 64,733

[22] Filed: Jun. 22, 1987

[30] Foreign Application Priority Data

Jun. 30, 1986 [IT] Italy ..... 59390/86[U]

[51] Int. Cl.[4] ..... A43B 7/02; A43B 5/04

[52] U.S. Cl. ..... 36/2.6; 36/117; 219/211

[58] Field of Search ..... 36/2.6, 117; 219/211, 219/527; 128/383

[56] References Cited

U.S. PATENT DOCUMENTS

| | | | |
|---|---|---|---|
| 3,859,496 | 1/1975 | Giese | 36/2.6 X |
| 4,273,989 | 6/1981 | Hintun et al. | 219/211 |
| 4,455,764 | 6/1984 | Rock et al. | 36/2.6 X |
| 4,697,359 | 10/1987 | Balbinot | 36/2.6 |

FOREIGN PATENT DOCUMENTS

| | | | |
|---|---|---|---|
| 0205110 | 12/1986 | European Pat. Off. | 36/2.6 |
| 3342276 | 6/1985 | Fed. Rep. of Germany | 36/2.6 |
| 3543351 | 6/1987 | Fed. Rep. of Germany | 36/2.6 |
| 2365973 | 4/1978 | France | 36/2.6 |

*Primary Examiner*—James K. Chi

*Attorney, Agent, or Firm*—Guido Modiano; Albert Josif

[57] ABSTRACT

The heating device is connectable to an electrical resistance heating circuit in a ski boot and comprises, at least one battery, a watertight box-like structure, a battery charger, a first circuit adapted for preventing overcharging of the battery, a second circuit adapted for preventing excessive discharging of the battery, and a third circuit adapted for controlling power fed to the electrical resistance heating circuit. The watertight box-like structure is removably associable with a ski boot, connectable to the electric resistance heating circuit, and adapted for containing the battery the first circuit, the second circuit, and the third circuit.

28 Claims, 4 Drawing Sheets

Fig. 8
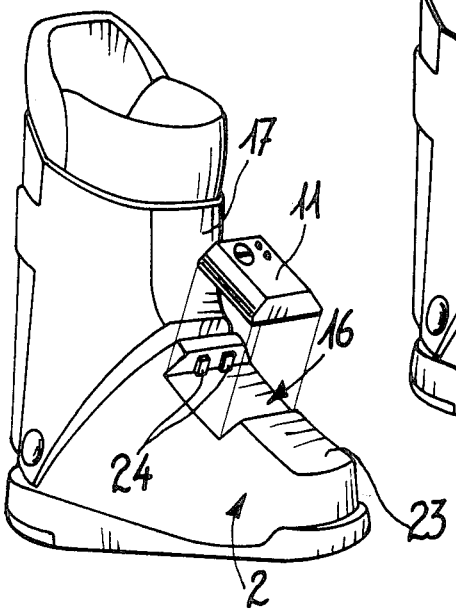
Fig. 9
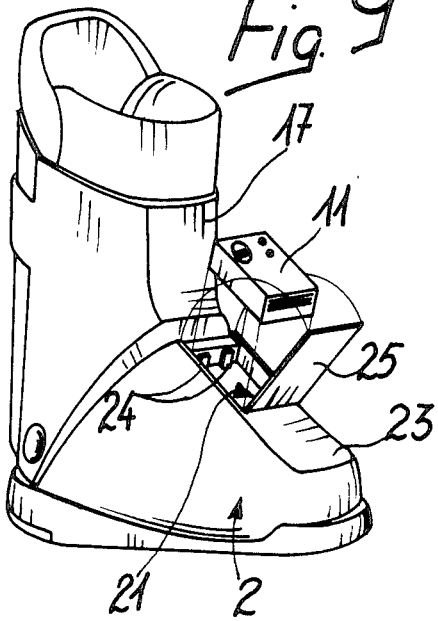
Fig. 10
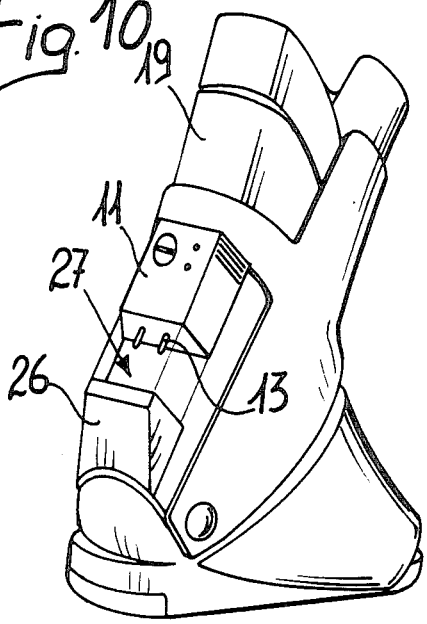
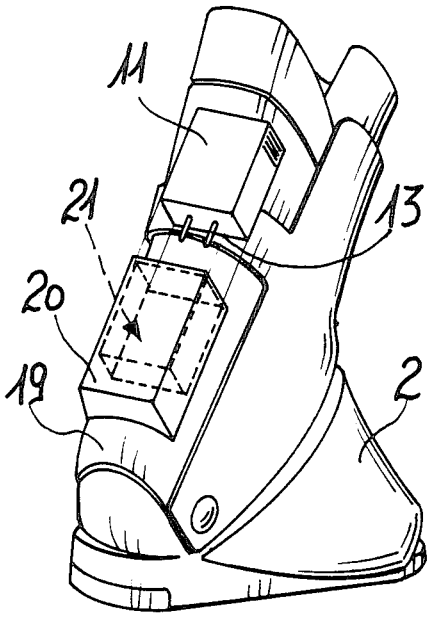
Fig. 11

HEATER DEVICE, PARTICULARLY FOR SKI BOOTS

BACKGROUND OF THE INVENTION

The present invention relates to a heating device, particularly for ski boots.

Currently known are devices for heating ski boots by using electrical energy.

Boots including such known devices comprise an inner boot which comprises an electric resistance heater connected to one or more rechargeable electric batteries.

Such batteries are electrically connected to a socket for permitting their recharging, which socket is accessible on the boot, the supply of power to the resistance heater being allowed by operating a suitable switch.

The main disadvantage found in such known devices resides in the fact that the ski boot must be placed proximate to an external electric power supply, and that the user must use a battery charger in order to restore the functionality of the batteries.

A partial solution to the disadvantage of having to place the boots proximate to a source of electric power, is disclosed by copending U.S. patent application Ser. No 06/861.287 filed on May 9, 1986, now U.S. Pat. No. 4,697,359 wherein a structure of an item of footwear is illustrated which is provided with a seat adapted for removably housing a rechargeable battery, on said structure there being provided a suitable switch intended to selectively allow the supply of power to an electric resistance heating circuit inserted within said item of footwear.

Also in this case, however, the disadvantage arises of the need to use an external battery charger for connection between a power supply and the rechargeable battery.

SUMMARY OF THE INVENTION

The main aim of the present invention is therefore to eliminate all of the disadvantages of known types of heating devices for ski boots.

Within the above-cited aim, an object of the invention is to provide a heating device which has means for supplying power to an electric resistor circuit contained within a ski boot and which allows direct recharging of the power which can be restored therein without requiring any external accessories and without the need to place said boot proximate to a power source.

A further important object of the invention is to provide a heating device which associates the above described characteristic with that of allowing said recharging in conditions of absolute safety for the user.

Another important object of the invention is to provide a device which furthermore allows its quick and easy replacement in case of maintenance, allowing at the same time the user to make use of the ski boots, even during recharging.

Another object of the invention is to devise a heating device with small dimensions and which is absolutely safe and reliable while skiing.

Still another object of the invention is to provide a heating device which allows an optimum supply of power to the electric resistance heating circuit within the ski boot, without requiring the user to perform said function by continuous and constant use of a switch interposed between said device and said circuit.

Not least object is to obtain a device which automatically presents any damage to the battery avoiding possible overcharging or excessive discharging thereof.

The aim and the objects mentioned above, as well as others which will become apparent hereinafter, are achieved by a heating device particularly for ski boots, comprising an electrical resistance heating circuit, characterized in that it comprises, in combination, at least one battery, a substantially watertight box-like structure, battery charging means, at least one first circuit adapted for preventing overcharging of said battery, at least one second circuit adapted for preventing excessive discharging of said battery, and at least one third circuit adapted for controlling power fed to said electrical resistance heating circuit, said substantially watertight box-like structure being removably associable with a ski boot, connectable to said electric resistance heating circuit, and adapted for containing said battery, said first circuit, said second circuit, and said third circuit.

BRIEF DESCRIPTION OF THE DRAWINGS

Further characteristics and advantages of the invention will become apparent from the detailed description of a particular embodiment, illustrated only by way of non-limitative example in the accompanying drawings where:

FIGS. 4 to 11 are perspective views illustrating eight possible different solutions for the accommodation of the box-like structure on the ski boot.

DESCRIPTION OF THE PREFERRED EMBODIMENTS

Figure 1:
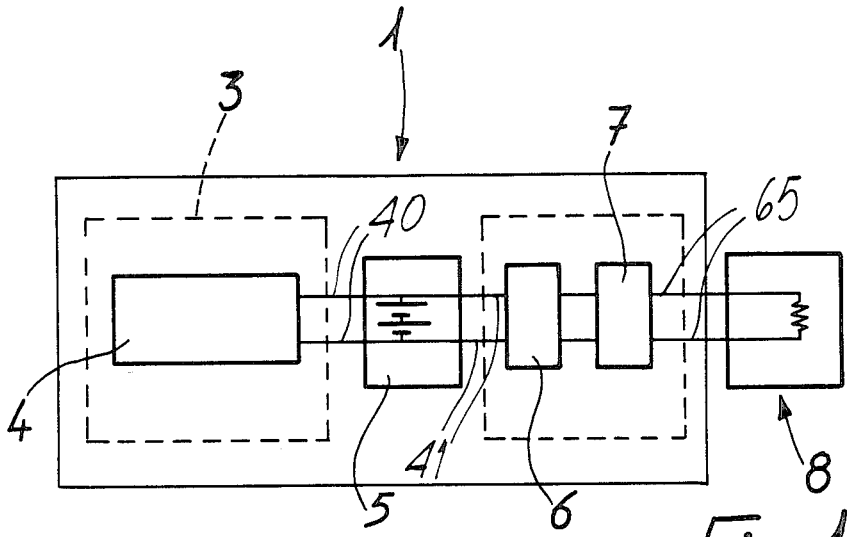
FIG. 1 is a block diagram of the device.
Figure 2:
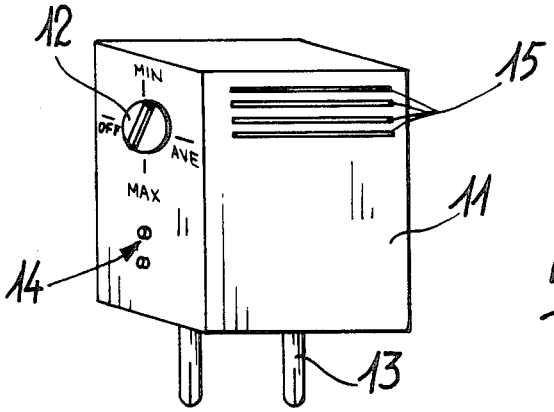
FIG. 2 is a perspective view of a particular box-like structure for the same.

With reference to the above described figures, the heating device 1, particularly for ski boots 2, comprises a battery charger 3 of the switching type, which allows recharging with voltage values ranging from 12 to 24 volts DC, and from 100 to 240 volts AC with automatic voltage level compensation. Said battery charger 3 comprises an automatic charge-cut off circuit 4 adapted to prevent overcharging of the battery and controlled by the charging time and/or the battery temperature, so as to stop charging when the charging time and/or the battery temperature exceed preset values. This battery charger 3 may be of any type suitable for allowing recharging of the battery through connection to an external, AC or DC, power supply; for example it may be the same as the battery charger incorporated in the shaver HP 1335 manufactured by Philips Shave.

The batteries, indicated at 5, are electrically connected, through line 40, to the battery charger 3 and, through line 41, to an automatic switch circuit 6 intended t cut off feeding of the heating resistor circuit 8 and thus to stop discharge of the batteries when the voltage across the batteries 5 falls below the present value, said automatic switch circuit allowing protection of the batteries, by preventing excessive discharge thereof.

The heating device 1 furthermore comprises a control circuit 7 for regulating the power fed to the resistor heating circuit 8 arranged in the ski boot 2.

The function of this control circuit 7 is thus to adjust the temperature within the ski boot according to the requirements of the user.

Advantageously, the control circuit 7 is of the nondissipating type, so as to allow the user, besides the adjustment of the temperature within the ski boot, also to increase the life of the batteries 5.

Figure 3B:
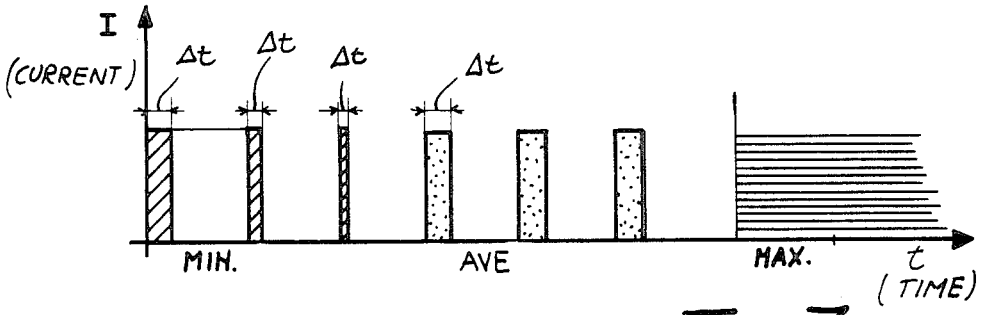
FIG. 3*b* shows the current versus time as supplied by the device to the heating circuit with different power regulations.
Figure 3A:
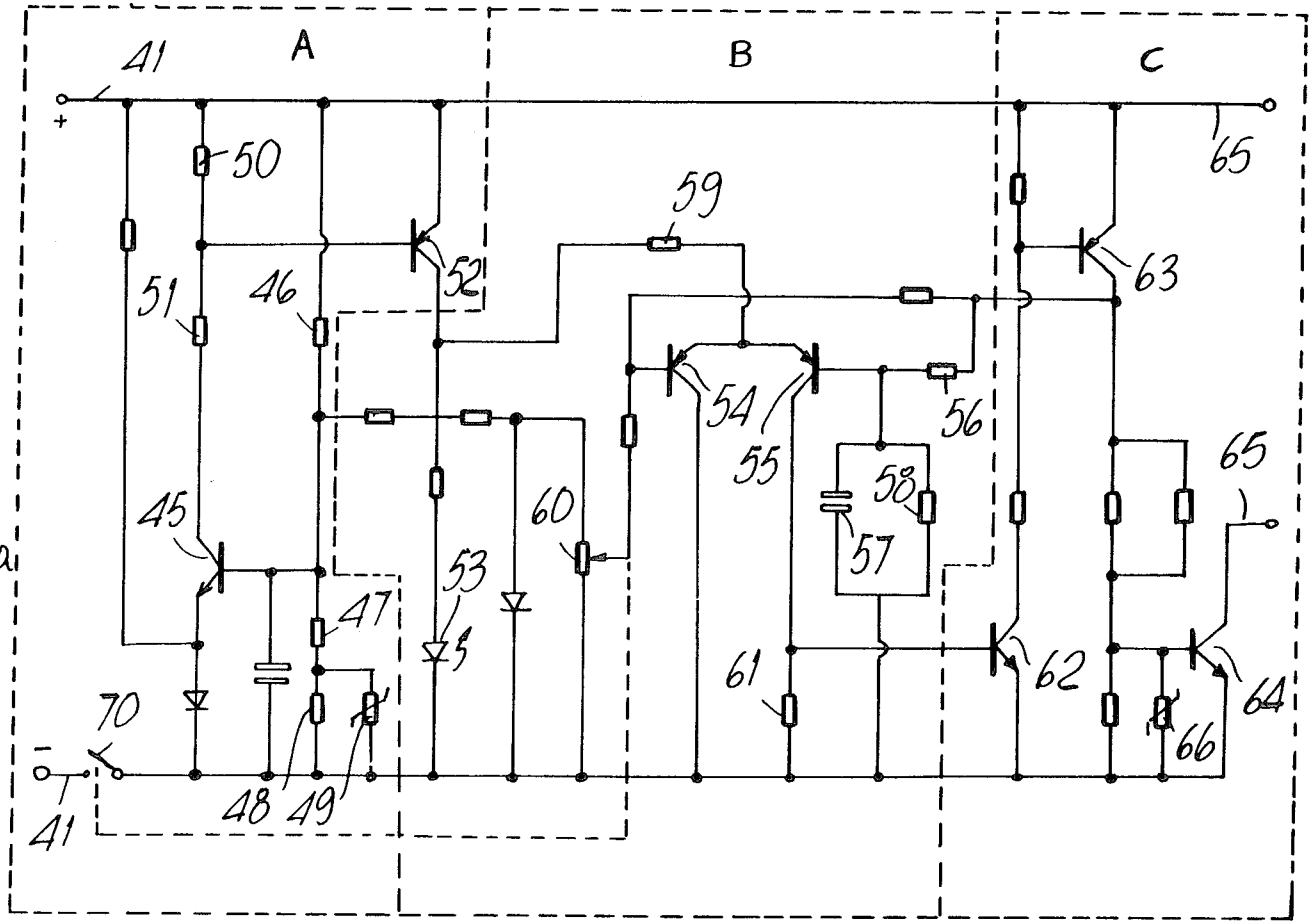
FIG. 3*a* shows a wiring diagram of a part of the device according to FIG. 1.

An illustrative embodiment of circuits 6 and 7 is shown in FIG. 3*a*, wherein section A corresponds to the automatic switch circuit 6 and sections B and C form the control circuit 7.

In detail, as visible, section A, fed on line 41, comprises a first transistor 45 which, biased by resistors 46–49, sets the operation threshold of the device. First transistor 45 drives, through resistors 50, 51, second transistor 52 which, during normal operation, is in the ON state and drives sections B and C. In this state, LED 53 is switched on. When the voltage of the batteries and thus the voltage drop on leads 41 falls below the operation threshold of section A, transistor 52 is switched off, thereby switching off sections B and C so as to stop feeding of the heater circuit 8. Resistor 49 of the NTC type is intended to thermally compensate transistor 45.

Section B defines the power regulation portion and includes a differential amplifier circuit driven by resistor 52 through transistor 59 and comprising transistors 54 and 55 and resistors 56–58 and capacitor 57 forming with the transistors 54,55 a self-exciter structure. Regulation of the duty cycle of this structure is obtained through potentiometer 60 which allows selection of the reference voltage of the differential amplifier circuit. The variable-width pulse fed by transistor 55 are then supplied, through resistor 61, to the base of transistor 62 of sections C. Potentiometer 60 is furthermore mechanically coupled to switch 70 arranged on line 41 to interrupt current flow.

This section C defines the final power section and includes a first, gain portion formed by transistors 62 and 63, and a second, power section formed by transistor 64 connected with its collector electrode to line 65 leading to the heating circuit 8. Resistor 66, of the NTC type, is connected between the base and emitter of transistor 64 and is intended to protect the latter against short-circuits by limiting the base current.

Thus, by acting on the potentiometer 60, connected to a knob 12 it is possible to reduce the current on the load as illustrated in FIG. 3*a*, wherein the current pulses have a duration $\Delta t$ which is a function of the angular position of the knob 12 connected to potentiometer 60, said adjustment allowing power supply for desired periods of time and thus achieving different temperatures in the boot.

In this manner, the user merely needs to select, by means of the knob 12, the setting deemed optimum, the control circuit 7 supplying power as selected until the voltage fed by the batteries falls below the set threshold and automatic switch circuit 6 causes switching off of control circuit 7 and therefore the resistor heating circuit 8.

The battery charger 3, the batteries 5, the circuits 4, 6 and 7 are all enclosed within a watertight box-like structure 11 carrying the control knob 12 for the potentiometer 60 and pins 13, in electrical contact with line 65, for connection to the heating circuit 8. The box-like structure 11 further carries a lamp 14 connected to the battery charger 3 and the LED 53 forming part, as already explained, of control circuit 7 for verifying the charge and the discharge of the batteries. According to the present embodiment, pins 13 may be used also to connect the device to an external recharging power supply, but further electrical connection elements may be instead provided for this purpose.

Advantageously, the box-like structure 11 has the shape of a parallelpipedon with external projections or ribs 15 adapted to facilitate gripping by the user.

The box-like structure 11 can be removably associated with ski boots 2, for example at a suitable flat seat 16 provided on the front quarter 17 of th boot and provided with a pair of sockets 18 for the pins 13 adapted to allow the electrical coupling thereof to the circuit 8.

Figure 5:
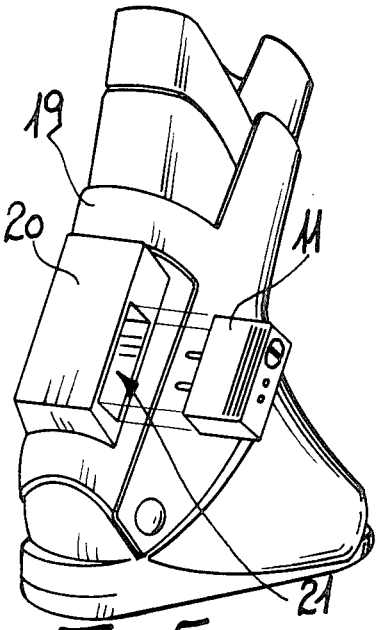
Figure 4:
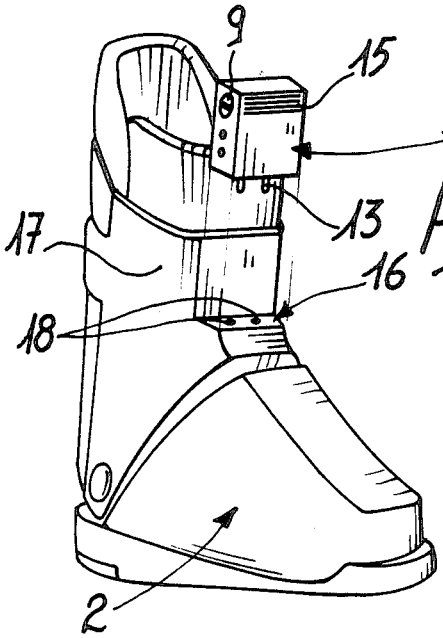

FIG. 5 illustrates a ski boot wich is provided, at the rear quarter 19, with a container 20 having a laterally-opening seat 21, configured so as to removably insert the box-like structure 11, also in this case there being provided, inside said seat, suitable sockets for the connection to the circuit 8 of the device 1.

Figure 6:
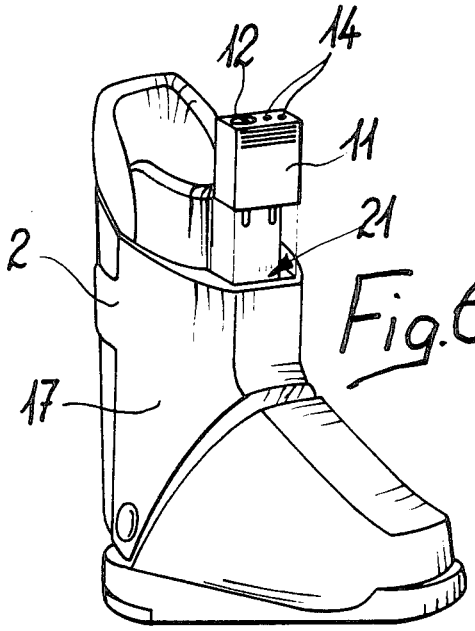

FIG. 6 instead illustrates a ski boot 2 having the front quarter 17 with a seat 21 upwardly open and configured so as to removably accommodate and surround the box-like structure 11 so as to protect it from possible shocks during skiing.

Naturally, the control knob 12 for the potentiometer, as well as the control lights 14 and 53, are positioned so as to be visible and accessible by the user.

Figure 7:
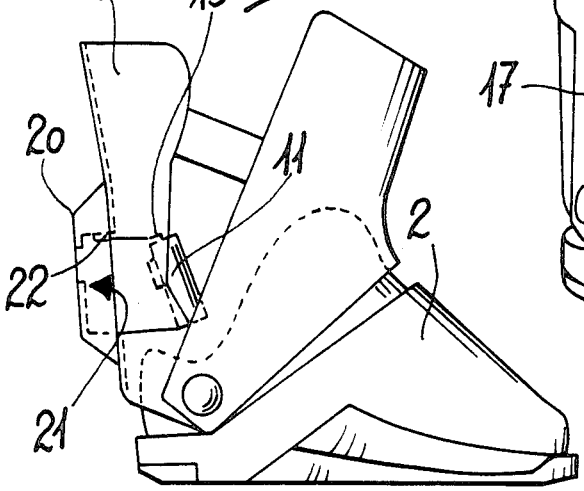

FIG. 7 illustrates a ski boot, having the container 20 at a rear portion of the quarter 19, in said embodiment the seat 21 opening towards the interior of the boot 2.

A recess is thus defined which is adapted to allow the removable insertion of the box-like structure 11, within said seat 21 there protruding present terminals 22 adapted to allow electrical connection to the pins 13.

FIG. 8 illustrates a ski boot 2, on the upper region of the shell 23 thereof adjacent to the front quarter 17 there being provided a seat 16 on which is removably placed a box-like structure 11 provided with sockets for the connection to the heating circuit 8, shaped complementarily with respect to preset pins 24 provided and projecting from said seat 16.

FIG. 9 illustrates a ski boot 2, on the upper region of the shell 23 whereof, adjacent to the front quarter 17, is provided, instead, a seat 21 adapted to accommodate the box-like structure 11, the same being protected within said seat, which can be closed by means of a suitable closure 25.

Also in this case, suitable pins 24 for the connection to the device 1 of the heating circuit 8 project from said seat 21.

FIG. 10 illustrates a ski boot 2, on the rear quarter 19 of which is provided and projects a projection 26 provided with a flat surface 27 facing towards the top of the boot 2, with which the box-like structure 11 is removably associable, by means of the pins 13, said protrusion 26 being provided with suitable sockets for the pins 13 so as to allow electrical connection of the device 1 to the circuit 8 within the boot.

FIG. 11 instead illustrates a ski boot 2, provided, at the rear quarter 19, with a container 20, provided with a seat 21 arranged therein and configured so as to removably accommodate the box-like structure 11.

Said seat is provided with an opening towards the upper end of the quarter 19.

Also in this case, inside the seat 21 suitable sockets are provided for the pins 13 which project from the box-like structure 11, said sockets allowing the electrical connection of the device 1 to the heating circuit 8 within the boot 2.

It has thus been observed that the invention achieves the intended aims and objects, a heating device having been provided which is associable with the ski boot, which can be removed therefrom and placed directly at a power source, said device allowing the recharging of the batteries inserted therein without the need of an external battery charger.

By virtue of the possibility of power supplies at various voltages, the user may, for example, recharge the batteries by electrically connecting the box-like structure 11 to the battery of the car while travelling towards the skiing resorts.

Furthermore, the insertion of the device within a watertight box-like structure prevents any malfunction due to possible water infiltration while skiing.

Moreover, if a fault occurs, the user can send the entire box-like structure 11 to be repaired, which in any case will still allow the boot to be used even with the box-like structure 11 removed therefrom.

The presence within the device of a circuit for regulation and power supply furthermore allows the user to achieve an optimum heating condition within the ski boot, it being possible to achieve said condition by reducing the current on the load.

Moreover, the presence of the automatic cut off and control circuits allows to keep the batteries always efficient even if the user fails to notice an excessively long use thereof or an excessively longlasting connection thereof to a power source.

The accommodation of said device within the box-like structure allows its quick and simple application to the ski boot, its modest dimensions not substantially affecting the aesthetic characteristics of the ski boot.

Naturally, the materials and the dimensions of the individual components, as well as the components of the individual circuits which compose the heating device, may be any according to specific requirements.

I claim:

1. Heating device particularly for ski boots, comprising an electrical resistance heating circuit, said device comprising, in combination, at least one battery, a substantially watertight box-like structure, battery charging means, at least one first circuit adapted for preventing overcharging of said battery, at least one second circuit adapted for preventing excessive discharging of said battery, and at least one third circuit adapted for controlling power fed to said electrical resistance heating circuit, said substantially watertight box-like structure being removably associable with a ski boot, connectable to said electric resistance heating circuit, and adapted for containing said battery, said first circuit, said second circuit, and said third circuit.

2. A device according to claim 1, wherein said battery is electrically connected to said battery charging means, to said first circuit, and to said second circuit.

3. A device according to claim 1, wherein said battery charging means is adapted for connection to direct current and alternating current external power sources having variable voltage values, and is adapted for charging said battery at a constant voltage value, said first circuit being an automatic charge cut-off circuit, adapted for automatically disconnecting said battery from said battery charging means according to predetermined parameters.

4. A device according to claim 1, wherein said second circuit is adapted for interrupting discharge of said battery upon said battery reaching a predetermined lower threshold voltage value.

5. A device, according to claim 1, wherein said third circuit is a non-dissipating control circuit, adapted for regulating power fed to said electrical resistance heating circuit contained in a ski boot.

6. Device according to claim 1, wherein said third circuit supplies power pulses, at a peak value, which is a function of the resistance of said heating circuit, and at preset and constant time periods, said device further comprising a potentiometer including control means adapted for having imparted thereto an angular position, said power pulses having a duration which is a function of said angular position imparted to said control means of said potentiometer, said power pulses being further controlled by said second circuit.

7. Device according to claim 6, wherein said watertight box-like structure has an essentially parallelepipedal shape, said control means for said potentiometer of said third circuit comprising a member located externally on said box-like body, said box-like body further comprising means for electrical connection to said battery charging means, means for electrical connection to said heating circuit, indicators for indicating the condition of charge and discharge of said at least one battery, and a plurality of grip projections.

8. Device according to claim 1, wherein said box-like structure is removably associable with said ski boot at a preset flat seat provided on the front quarter of the boot, said seat being provided with a pair of sockets for pins of said box-like structure, adapted to allow the electrical connection of said device to said heating circuit.

9. Device according to claim 1, wherein said box-like structure is removably associable with said ski boot at the rear quarter thereof, from said quarter there projecting a container provided with a seat having an opening, configured so as to allow the removable insertion of the box-like structure, inside said seat there being provided suitable sockets for the connection of said device to said heating circuit.

10. Device according to claim 1, wherein said box-like structure is removably associable with said ski boot at a matchingly shaped seat, provided with an upward opening, provided at the front quarter of said boot.

11. Device according to claim 1, wherein said box-like structure is removably associable with said ski boot at a suitable container, provided on the rear quarter of said boot, said container having a seat with an opening facing towards the interior of said boot to define a recess adapted to allow the removable insertion of said structure, within said seat there projecting terminals adapted to allow the electric connection between said device and said heating circuit.

12. Device according to claim 1, wherein said box-like structure is removably associable with said ski boot at a suitable seat, provided at the upper region of the shell adjacent to the front quarter of said boot, on said seat there being provided suitable sockets for the connection of said device to the heating circuit.

13. Device according to claim 12, wherein said box-like structure is removably associable with said ski boot at a suitable seat, provided at the upper region of the shell adjacent to the front quarter of said boot said seat being closeable by means of a lid, from said seat there projecting pins for the electric connection of said device to said heating circuit.

14. Device according to claim 1, wherein said box-like structure is removably associable with said ski boot at a projection protruding at the rear of the rear quarter of said boot, said projection being provided with a flat surface facing towards the top of said boot and having suitable sockets for the electrical connection of said device to said heating circuit.

15. In combination, a ski boot having an electrical resistance heating circuit, and a heating device comprising, at least one rechargeable battery, a substantially watertight box-like structure, battery charging means, at least one first circuit, at least one second circuit and at least one third circuit, said box-like structure being substantially watertight and connectable to said ski boot, said rechargeable battery being housed in said box-like structure and adapted for feeding power to said electrical resistance heating circuit, said first circuit being adapted for preventing overcharging of said rechargeable battery, said second circuit being adapted for preventing excessive discharging of said rechargeable battery, said third circuit being adapted for controlling power fed to said electrical resistance heating circuit, said box-like structure being further adapted for containing, said first circuit, said second circuit, and said third circuit.

16. A combination according to claim 15, wherein said rechargeable battery is electrically connected to said battery charging means, said first circuit, and said second circuit.

17. A combination according to claim 16, wherein said battery charging means is connectable to direct current and alternating current external power sources having variable voltage values, and adapted for charging said rechargeable battery at a constant voltage value, said first circuit being an automatic charge cut-off circuit, said automatic charge cut-off circuit being adapted for automatically disconnection said rechargeable battery from said battery charging means according to predetermined parameters.

18. A combination according to claim 15, wehrein said rechargeable battery has a predetermined lower threshold voltage value, and wherein said second circuit is adapted for disconnecting said rechargeable battery from said electrical resistance heating circuit upon said rechargeable battery reaching said predetermined lower threshold voltage value.

19. A combination, according to claim 15, wherein said third circuit is a non-dissipating control circuit, said non-dissipating control circuit being adapted for regulating power fed from said rechargeable battery to said electrical resistance heating circuit.

20. A combination according to claim 15, wherein said third circuit supplies power pulses to said electrical resistance heating circuit at preset and constant time internals said power pulses having a peak value and a duration, said electrical resistance heating circuit defining a resistance, said peak value of said power pulses being determined according to said resistance defined by said electrical resistance heating circuit, said third circuit further comprising a potentiometer, said potentiometer including control means, said control means being adapted for defining an angular position, said potentiometer being adapted for controlling said duration of said power pulses according to said angular position defined by said control means,said secnd circuit being adapted for further controlling said power pulses.

21. A combination according to claim 20, wherein said box-like structure has an essentially parallelepipedal shape, and wherein said rechargeable battery has a condition of charge and discharge, said control means comprising a member located externally on said box-like body, said box-like body further comprising means for electrical connection to said battery charging means, means for electrical connection to said heating circuit, indicators for indicating said condition of charge and discharge of said rechargeable battery, and a plurality of grip projections.

22. A combination according to claim 15, wherein said box-like structure has rigidly associated therewith a plurality of pins, and wherein said ski boot has at least one flat seat, a plurality of sockets and a front quarter, said flat seat being located on said front quarter, said sockets being arranged at said flat seat and adapted for accommodating said plurality of pins, said pins being adapted for electrically connecting said heating device to said electrical resistance heating circuit.

23. A combination according to claim 15, said ski boot has a rear quarter, and wherein said box-like structure is connected to said ski boot at said rear quarter, from said rear quarter there projecting a container, said container including a seat, said seat having sockets and an opening, said opening being configured so as to allow insertion of said box-like structure, into said seat, said sockets being provided ons aid seat and adapted for connecting of said heating device to said electrical resistance heating circuit.

24. A combination according to claim 15, wherein ski boot has a front quarter, said front quarter having formed thereon at least one seat, said seat having an upward opening and being located at said front quarter of said boot.

25. Combination according to claim 15, wherein ski boot has an interior portion, a rear quarter and a container, said container being located at said rear quarter and having formed thereon a seat, said seat having an opening, said opening facing said interior portion of said ski boot to define a recess, said recess being adapted to accommodate said box-like structure, seat further comprising terminals, said terminals being adapted for electrically connecting said heating device to said electrical resistance heating circuit.

26. A combination according to claim 15, wherein said ski boot has a shell, a seat, a front quarter, and an upper region, said upper region, being defined on said shell adjacent to said front quarter said seat located at said upper region, adapted for housing said box-like structure, and having located therein a plurality of sockets, said sockets being adapted for connecting said heating device to said electrical resistance heating circuit.

27. A combination according to claim 26, further comprising a lid, said lid being adapted for closing said seat.

28. A combination according to claim 15, wherein said ski boot has at least one projection, and a rear quarter, said projection protruding from said rear quarter of said ski boot, and having a flat surface facing upwardly and having sockets, said sockets being adapted for electrically connecting said heating device to said electrical resistance heating circuit.

* * * * *